US007134647B2

(12) United States Patent
Graber

(10) Patent No.: US 7,134,647 B2
(45) Date of Patent: Nov. 14, 2006

(54) LOCK

(75) Inventor: Loren R. Graber, Nappanee, IN (US)

(73) Assignee: Digger Specialties, Inc., Bremen, IN (US)

( * ) Notice: Subject to any disclaimer, the term of this patent is extended or adjusted under 35 U.S.C. 154(b) by 0 days.

(21) Appl. No.: 10/986,590

(22) Filed: Nov. 12, 2004

(65) Prior Publication Data

US 2005/0211969 A1 Sep. 29, 2005

Related U.S. Application Data

(60) Provisional application No. 60/519,357, filed on Nov. 12, 2003.

(51) Int. Cl.

| | |
|---|---|
| ***E04H 17/00*** | (2006.01) |
| ***E04H 17/14*** | (2006.01) |
| ***E04H 17/20*** | (2006.01) |
| ***E04H 17/24*** | (2006.01) |
| ***E04H 17/22*** | (2006.01) |

(52) U.S. Cl. ..... 256/65.02; 256/65.03; 256/22; 256/65.11; 256/65.12; 403/DIG. 11

(58) Field of Classification Search ..... 403/339, 403/336, 270, 237, 247, 397, DIG. 14; 256/70, 256/65.09, 65.01, 65.04, 65.08, 65.11, 65.12, 256/65.13; 24/297, 662, 671, 682
See application file for complete search history.

(56) References Cited

U.S. PATENT DOCUMENTS

| | | | | |
|---|---|---|---|---|
| 2,614,827 | A | 10/1952 | Peach et al. | |
| 2,946,612 | A * | 7/1960 | Ahlgren | 292/17 |
| 3,756,567 | A | 9/1973 | Murdock | |
| 3,949,836 | A | 4/1976 | Russo | |
| 3,955,801 | A | 5/1976 | Soriero | |
| 4,506,419 | A * | 3/1985 | Mitomi | 24/297 |
| 5,150,885 | A | 9/1992 | Leone | |
| 5,192,056 | A * | 3/1993 | Espinueva | 256/65.06 |
| 5,649,783 | A * | 7/1997 | Ichikawa et al. | 403/386 |
| 6,155,741 | A | 12/2000 | Took | |
| 6,209,175 | B1 * | 4/2001 | Gershenson | 24/297 |
| 6,543,751 | B1 * | 4/2003 | Spruill | 256/65.04 |
| 6,680,669 | B1 * | 1/2004 | Terry | 340/5.64 |
| 2005/0127344 | A1 * | 6/2005 | Graber | |

* cited by examiner

*Primary Examiner*—Daniel P. Stodola
*Assistant Examiner*—Nahid Amiri
(74) *Attorney, Agent, or Firm*—Barnes & Thornburg LLP

(57) ABSTRACT

A lock secures a first member to a second member, such as a fence rail to a post. The lock may include a lock body, a first locking element and a second locking element. The first locking element and second locking element may secure the lock to the first member and second member, respectively. Preferably, the lock is hidden from view in use.

24 Claims, 5 Drawing Sheets

LOCK

RELATED APPLICATIONS

The present application is related to and claims priority to U.S. Provisional Patent Application Ser. No. 60/519,357, filed on Nov. 12, 2003, entitled Hidden Lock For Fence Rails. The subject matter disclosed in that provisional application is hereby expressly incorporated into the present application.

FIELD OF THE INVENTION

The present invention relates generally to a lock, and more particularly, to a lock used to secure a pair of members together.

BACKGROUND AND SUMMARY OF THE INVENTION

A lock used for securing various members to one another serves several purposes. The lock will allow the connection of the members to be hidden behind the exteriors of the connected members, giving the connection a more aesthetically pleasing appearance. The hidden lock will also allow a quicker, less cumbersome connection, while at the same time form a stable connection. One illustrative application of this hidden lock is to secure a fence rail and fence post to one another.

Several methods for connecting fence rails to fence posts for purposes of constructing a fence currently exist. One method is welding a fence rail and a fence post together. Another is by connecting a bracket to the fence rail and fence post.

One embodiment of the present invention is a hidden lock formed of plastic. The hidden lock allows a fence rail to be connected to a fence post. The design of the hidden lock allows it to fit into a fence rail designed to receive the hidden lock. In this embodiment, the hidden lock has a rectangular cross-section allowing it to fit into a similarly-shaped fence rail. However, alternative embodiments of the hidden lock may exist to accommodate other fence rail shapes, such as cylindrical, for example. This embodiment of a hidden lock has a feature to connect the hidden lock to the fence rail. This embodiment also has a feature which connects a generally horizontal fence rail to a generally vertical fence post. The fence post has an opening through which a portion of the fence rail may be inserted along with the hidden lock. This embodiment allows the hidden lock to then connect the fence rail and fence post together.

Another embodiment of a hidden lock comprises a first and second groove, allowing the hidden lock to fit inside a fence rail having ridges to fit in the grooves of the hidden lock. This embodiment further comprises a ridge on the end of the hidden lock extending at least to the periphery of the first fence rail, allowing the hidden lock to be received by the fence rail until the ridge is immediately adjacent the end of the fence rail. The hidden lock also has a tab capable of being displaced when the hidden lock is inserted into a fence rail. The tab moves back into its original position when the hidden lock moves into a position within the fence rail allowing the tab to move through an opening located through the fence rail.

The hidden lock of this embodiment also has a wedge, which can be displaced and which is exposed with the hidden lock inside of the fence rail. A generally horizontal fence rail portion is then inserted into a generally vertical fence post having an opening to receive the fence rail portion and the hidden lock, with the size of the opening such that the wedge is displaced. When the fence rail portion and hidden lock are inside the fence post allowing the wedge to move back into its original position, the wedge end is then in a position such that the fence rail portion and the hidden lock cannot be displaced in the opposite direction of insertion without the wedge being displaced such that the wedge end no longer obstructs the fence rail portion and hidden lock from being removed from the fence post.

Additional embodiments, features and advantages will become apparent to those skilled in the art upon consideration of the following description of the illustrated embodiment exemplifying the best mode of carrying out the invention.

BRIEF DESCRIPTION OF DRAWINGS

Several embodiments of the present invention are shown in detail in connection with the following drawings, in which.

DETAILED DESCRIPTION OF THE DRAWINGS

Figure 1:
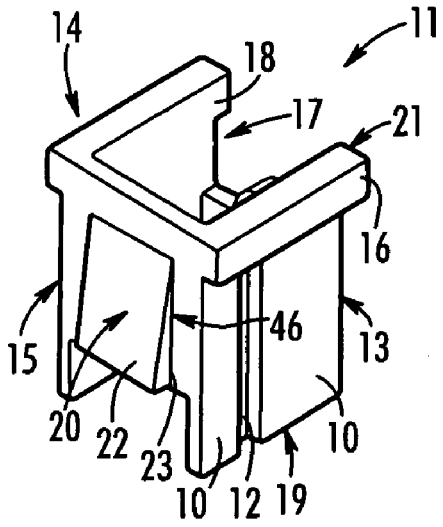
FIG. 1 is a perspective view showing an illustrative embodiment of a hidden lock.

A perspective view of an illustrative embodiment of a hidden lock 11 is shown in FIG. 1. In this embodiment, hidden lock 11 is formed of plastic, however, it is appreciated that hidden lock 11 may be formed of various materials, such as metals, for example. Hidden lock 11 has sides 13, 17, bottom 15, top 21, and ends 14, 19. Sides 13, 17 are each connected to bottom 15 and top 21 giving hidden lock 11 a rectangular cross-section, as illustratively shown in FIG. 1. It is appreciated that hidden lock 11 may be of various shapes, such as cylindrical, for example. Side 13 also has a groove 12 extending along exterior 10 of side 13. End 14 has ridge 16 which extends outwardly beyond sides 13, 17 and top 21. Bottom 15 illustratively comprises an exterior 24, wedge 20, and wedge slots 46, 48. Wedge 20 has a wedge bottom 22, a wedge end 36, and wedge sides 23. The existence of wedge slots 46, 48 allow wedge 20 to be displaced from its position illustratively shown in FIG. 1.

Figure 2:
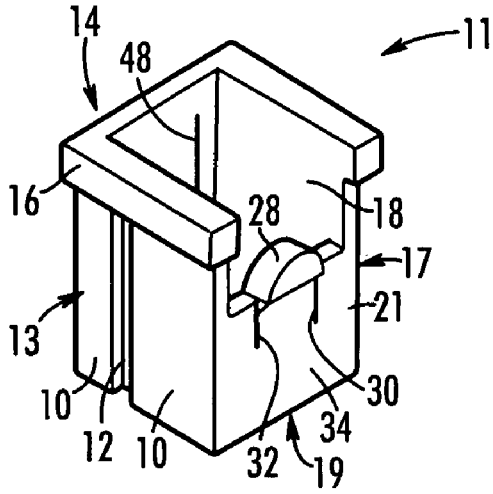
FIG. 2 is another perspective of the illustrative embodiment of the hidden lock shown in FIG. 1.

Another perspective view of the illustrative embodiment of hidden lock 11 is shown in FIG. 2. Top 21 has an exterior 34, tab 28 and tab slots 30, 32. Tab slots 30, 32 allow tab 28 to be displaced from its position illustratively shown in FIG. 2. Wedge slot 48 is also illustratively shown in FIG. 2.

Figure 3:
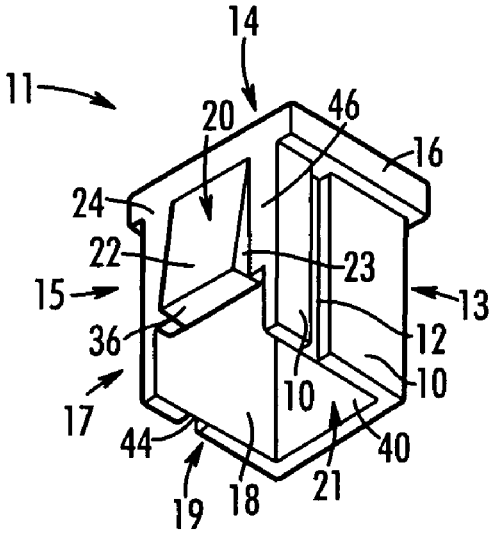
FIG. 3 is another perspective of the illustrative embodiment of the hidden lock shown in FIGS. 1–2.

Another perspective view of the illustrative embodiment of the hidden lock 11 is shown in FIG. 3. Top 21 has an interior 40. Side 17 has an interior 18. Side 17 also has groove 44 which extends along side 17, similar to that illustratively shown with groove 12 and side 13. FIG. 3 illustratively shows wedge bottom 36.

Figure 4:
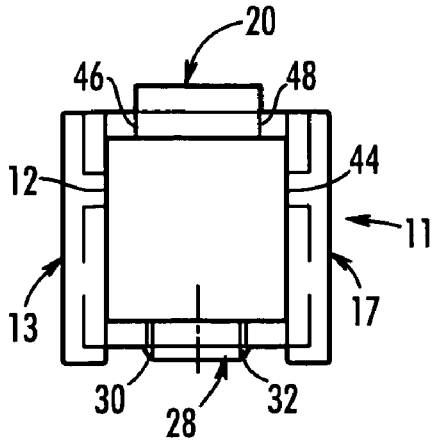
FIG. 4 is an end view of the illustrative embodiment of the hidden lock shown in FIGS. 1–3.

A top view of the embodiment of hidden lock 11 is illustratively shown in FIG. 4.

Figure 5:
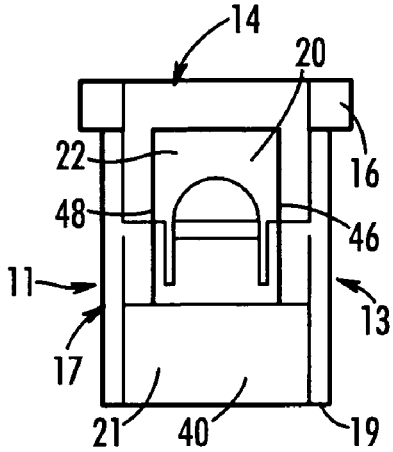
FIG. 5 is a bottom view of the illustrative embodiment of the hidden lock shown in FIGS. 1–4.

A bottom view of the embodiment of hidden lock 11 is illustratively shown in FIG. 5.

Figure 6:
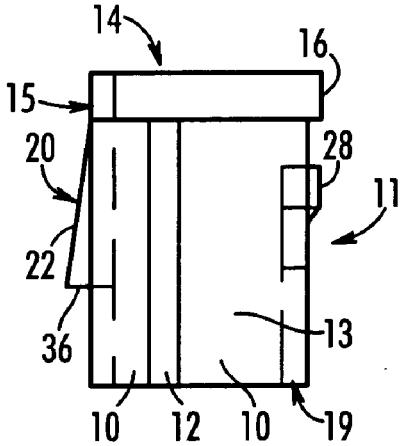
FIG. 6 is a side view of the illustrative embodiment of the hidden lock shown in FIG. 1–5.

A side view of the embodiment of hidden lock 11 is illustratively shown in FIG. 6.

Figure 7:
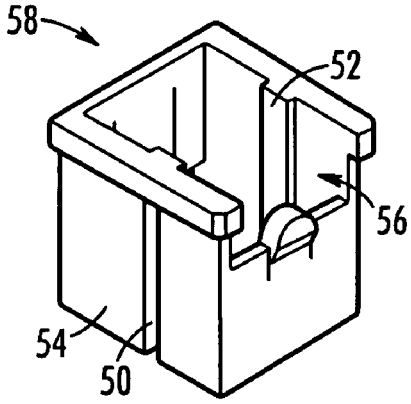
FIG. 7 is a perspective view of the illustrative embodiment of another hidden lock.

A perspective view of another embodiment of a hidden lock 58 is illustratively shown in FIG. 7. Hidden lock 58 is similar to that of hidden lock 11 illustratively shown in FIGS. 1–6, except for the configuration of grooves 50, 52. Grooves 12, 44 of hidden lock 11 are made of areas where portions of sides 13, 17, respectively, have been removed. Grooves 50, 51, however, are displacements of sides 54, 56 of hidden lock 58.

Figure 8:
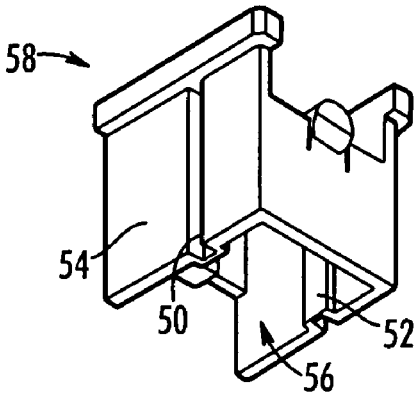
FIG. 8 is a another perspective view of the illustrative embodiment of the hidden lock shown in FIG. 7.

Another perspective view of the embodiment of hidden lock 58 is illustratively shown in FIG. 8.

Figure 9:
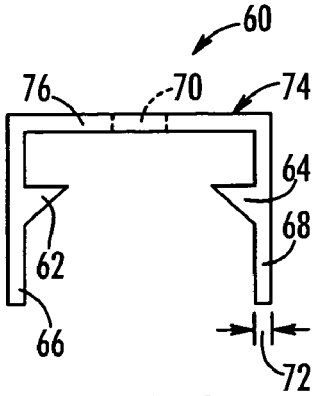
FIG. 9 is an end view of an illustrative embodiment of a fence rail.

An end view of an embodiment of a fence rail 60 that may be used with hidden lock 11 is illustratively shown in FIG. 9. In this embodiment, fence rail 60 is formed of aluminum, however, it is appreciated that fence rail 60 may be formed of various materials, such as plastics or other metals, for example. It is also appreciated that fence rail 60 is only an illustration of one style of fence rail that may be used with an embodiment of the hidden lock. Fence rail 60 has a top 74 and sides 66, 68. Sides 66, 68 are connected to top 74, as illustratively shown in FIG. 9. Fence rail 60 has a thickness 72. Fence rail 60 has ridges 62, 64 which extend along the interiors 65, 67, respectively, of sides 66, 68, respectively, with ridges 62, 64 being substantially parallel to top 74. Ridges 62, 64 are configured to fit into grooves of a hidden lock embodiment, for example, grooves 12, 44 of hidden lock 11. (See FIGS. 1–6.) Fence rail 60 also illustratively comprises opening 70, located through top 74, which is configured to receive the tab of a hidden lock through top 74, for example, tab 28 of hidden lock 11.

Figure 10:
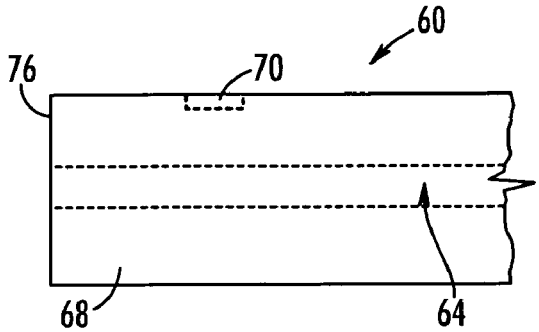
FIG. 10 is a side view of the illustrative embodiment of the fence rail shown in FIG. 9.

A side view of a portion of fence rail 60 is illustratively shown in FIG. 10. This view illustratively shows where opening 70 may be positioned relative to end 76. This view also illustrates how ridge 64 extends along side 68, with ridge 62 extending in a similar way along side 66.

Figure 11:
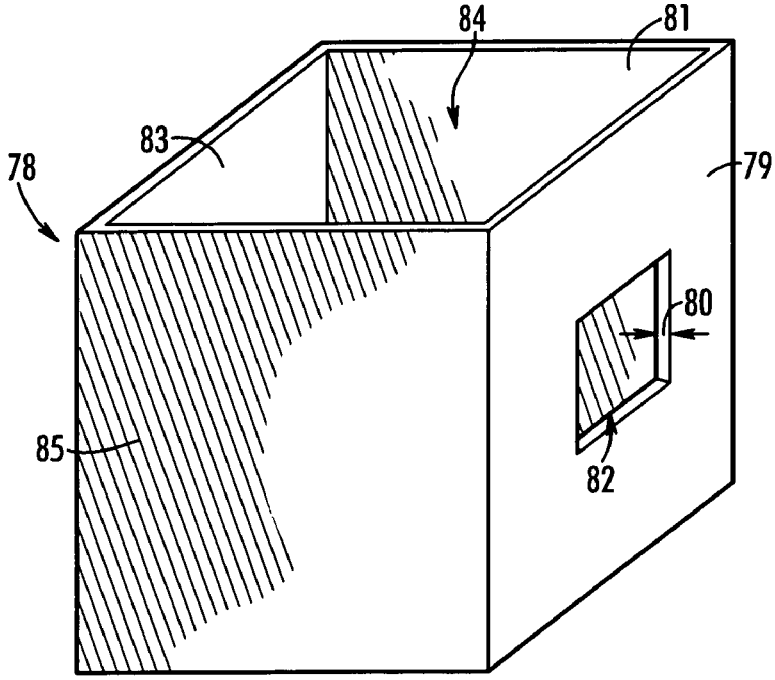
FIG. 11 is a perspective view of an illustrative embodiment of a fence post.

A perspective view of a fence post 78 is illustratively shown in FIG. 11. Fence post 78 is another embodiment of a fence rail that may be used with a hidden lock embodiment, such as hidden lock 11, for example. In this embodiment, fence post 78 is illustratively formed of aluminum, however, it is appreciated that fence post 78 may be formed of various materials, such as plastics or other metals, for example. Fence post 78 has a rectangular cross-section with sides 79, 81, 83, 85, with the fence interior 84 being hollow. It is appreciated that fence post 78 may be of various shapes, such as cylindrical, for example. Fence post 78 has a thickness 80. Fence post 78 also has an opening 82 through side 79. In this embodiment, opening 80 is rectangular in shape. It is appreciated that opening 80 can be of various shapes, such as circular or triangular, for example, to accommodate differently-shaped embodiments of a hidden lock.

Figure 12:
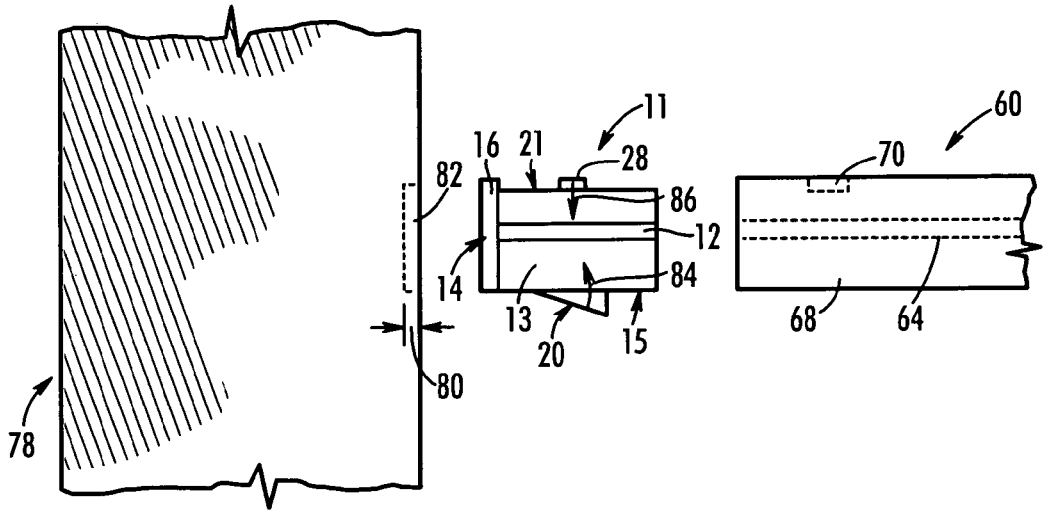
FIG. 12 is an exploded view of illustrative embodiments of a hidden lock, the fence rail shown in FIG. 10, and the fence post shown in FIG. 11.

An exploded side view of a portion of fence post 78, a portion of fence rail 60, and hidden lock 11 is illustratively shown in FIG. 12. This illustration contemplates that the embodiment of fence post 78 is generally vertical with fence rail 60 being generally horizontal. Opening 82 of fence post 78 is of a dimension to receive end 14 of hidden lock 11, while at the same time being small enough to require that wedge 20 be displaced in an upwardly direction 84 towards top 21 to allow hidden lock 11 to be able to pass through opening 82. Once wedge 20 is through opening 82, wedge 20 may return to its original position illustratively shown in FIG. 12. This view also shows groove 12 to be lined up with ridge 64, allowing ridge 64 to fit into groove 12 when hidden lock 11 is received by fence rail 60. Similarly, ridge 62 fits into groove 44. (See, also, FIGS. 3 and 9.) When hidden lock 11 is received by fence rail 60, tab 28 may be displaced in a downwardly direction 86, so that tab 28 can slide under top 74. Opening 70 is of a dimension to receive tab 28 with hidden lock 11 inserted into fence rail 60, so that tab 28 may return to its original position illustratively shown in FIG. 12. Opening 70 is also located from end 76 such that tab 28 fits into opening 70 when ridge 16 is directly adjacent to end 76. (See, also, FIG. 13.)

Figure 13:
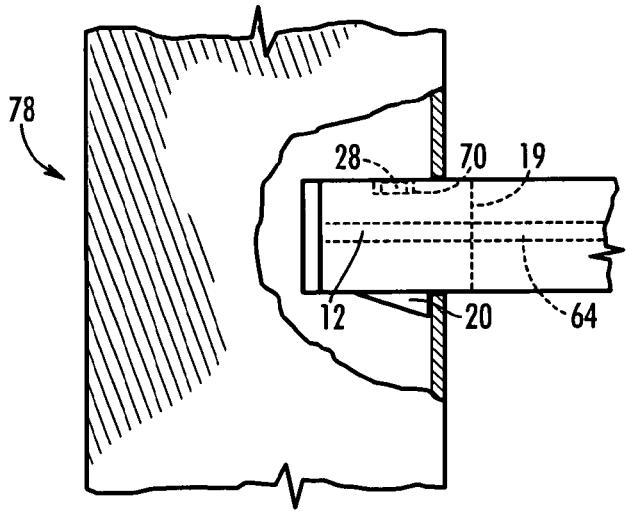
FIG. 13 is a side view of illustrative embodiments of a hidden lock, a fence rail, and a fence post.

A side view with a portions broken away of a portion of fence post 78 with a portion of fence rail 60 and hidden lock 11 all connected together is illustratively shown in FIG. 13. A portion of fence post 78 is broken away to allow hidden lock 11 to be shown. The connection of fence rail 60 and fence post 78 through hidden lock 11 is illustratively shown in FIG. 13. As discussed in the foregoing, wedge 20 may be displaced so that hidden lock 11 may be received by fence post 78 through opening 82. Wedge 20 is illustratively in a position that keeps hidden lock 11 from moving in a direction opposed to that in which hidden lock 11 was received by fence post 78. Tab 28 is illustratively shown to be positioned in opening 70. This position keeps hidden lock 11 connected with fence rail 60, which in turn keeps fence rail 60 connected with fence post 78 due to the position of wedge 20. Ridge 64 is illustratively shown to be in groove 12 in FIG. 13.

Figure 14:
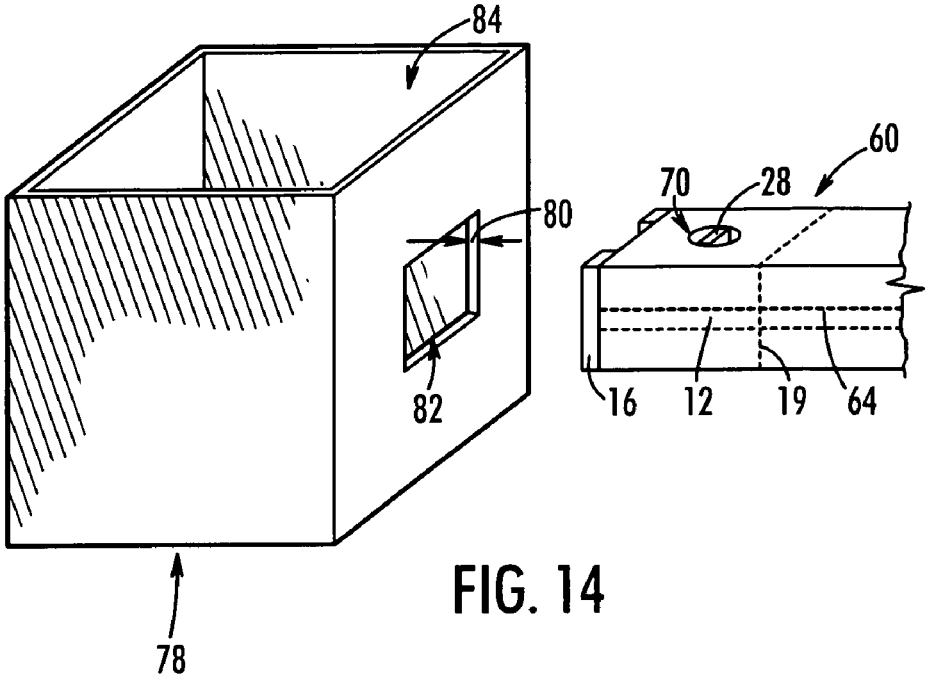
FIG. 14 is a perspective view of illustrative embodiments of a hidden lock, a fence rail, and a fence post.

A perspective view of hidden lock 11 connected to fence rail 60 before being connected to fence post 78 is illustratively shown in FIG. 14. This view illustratively shows how tab 28 is positioned through opening 70 when hidden lock 11 is inserted into fence rail 60.

Figure 15:
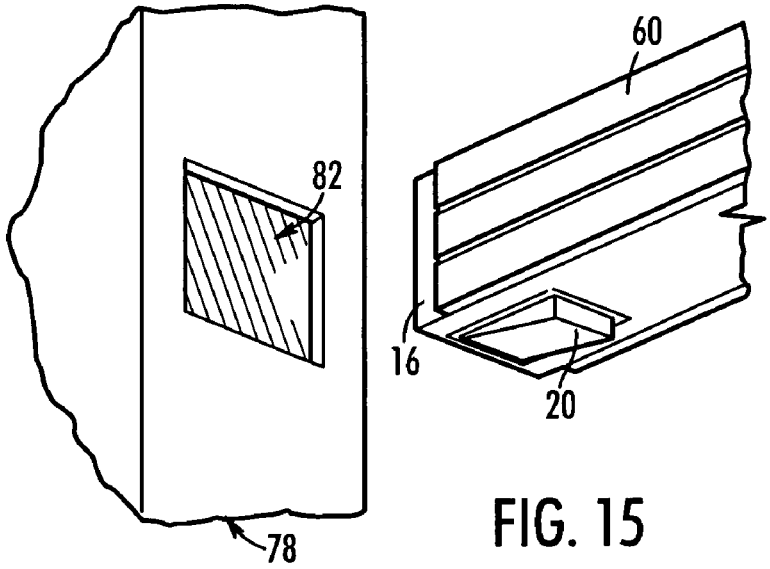
FIG. 15 is another perspective view of FIG. 14.

Another perspective view of hidden lock 11 connected to fence rail 60 before being connected to fence post 78 is illustratively shown in FIG. 15. This view illustratively shows wedge 20 being exposed, with hidden lock 11 inside of a fence rail 60. This exposure of wedge 20 allows the wedge to be displaced while being received by fence post 78 through opening 82, then, return to its original position as shown in FIG. 15 with wedge 20 being completely through opening 82. (See, also, FIG. 13.)

It is appreciated that the embodiments disclosed in the foregoing represent fence post 78 as being generally vertical and fence rail 60 as being generally horizontal. However, it is contemplated that an individual skilled in the art could apply hidden lock 11 to various combinations of members for connection. The hidden lock may also be used with various members disposed in various relative orientations, in addition to the generally horizontal and generally vertical orientations discussed. Therefore, the embodiments disclosed herein are not intended to limit the manner in which hidden lock 11 may be utilized.

Although the above description refers to particular means, materials and embodiments, one skilled in the art can easily ascertain the essential characteristics of the present invention. Various changes and modifications may be made to adapt to various uses and characteristics without departing from the spirit and scope of the present invention as set forth in the following claims.

What is claimed is:

1. An assembly comprising:

a) a rail having an open end and having an opening disposed therethrough;

b) a post having an opening disposed therethrough; and c) a lock formed to be disposed in the open end of said rail, said lock comprising:

d) a plurality of sides;

e) a tab extending outwardly from a side of said lock, said tab being resilient and displaceable from a first position; and f) a locking member extending outwardly from a side of said lock, said locking member being resilient and displaceable from a first position;

g) wherein, said tab is displaced from said first position by an interior surface of said rail when said lock is disposed within the open end of said rail, said tab returning to said first position when said tab is aligned with the opening in said rail and disposed therethrough securing said lock within said rail; and h) wherein, said locking member is displaced from said first position by an edge of the opening in the post when the end of said rail and a portion of said lock including said locking member are being disposed through the opening in said post, said locking member returning to said first position when said locking member is disposed through the opening in said post; and thereby securing said rail and said post to one another.

2. An assembly comprising:

a first member;

a second member;

a lock body;

a first locking element configured to secure said lock body to said first member;

a second locking element configured to secure said lock body to said second member when at least a portion of said lock body passes through an opening in said second member such that said lock body is hidden from view;

wherein said first member comprises a first wall, a second wall, and a third wall, wherein said second wall and said third wall extend from said first wall in a substantially perpendicular manner; and wherein said second locking element is positioned between said second wall and said third wall when said first locking element secures said lock body to said first member.

3. The assembly of claim 2, wherein at least a portion of said lock body is contained within said first member and at least a portion of said first member is hidden from view when said second locking element secures said lock body to said second member.

4. The assembly of claim 2, wherein at least a portion of said first member is disposed within said second member when said second locking element secures said lock body to said second member.

5. The assembly of claim 2, wherein said first member is a rail and said second member is a post.

6. The assembly of claim 2, wherein said first locking element is configured to engage a portion of said first wall.

7. The assembly of claim 2, wherein said first member and said second member are elongated.

8. The assembly of claim 2, wherein said first locking element and said second locking element are formed on an exterior surface of said lock body.

9. The assembly of claim 2, wherein said first locking element is displaced by an interior surface of said first member when a portion of said lock body is disposed in said first member until said first locking element is aligned with an opening in said first member and disposed therethrough.

10. The assembly of claim 5, wherein said rail is oriented substantially perpendicularly to said post.

11. The assembly of claim 7, wherein said lock body is elongated and wherein said lock body and said first member have a common longitudinal axis when said first locking element secures said lock body to said first member.

12. The assembly of claim 2, wherein said second locking element is displaced from a first position by an edge of said opening in said second member when a portion of said first member and a portion of said lock body are inserted in said opening in the second member, and wherein said second locking element returns to said first position when said second locking element is through said opening so as to secure the first and second members to one another.

13. An assembly comprising:

a first member;

a second member;

a lock body;

a first locking element configured to secure said lock body to said first member;

a second locking element configured to secure said lock body to said second member when at least a portion of said lock body passes through an opening in said second member such that said lock body is hidden from view; and wherein said lock body defines at least one groove on a peripheral side that is dimensioned to receive at least one ridge formed on an interior surface of said first member.

14. The assembly of claim 13, wherein at least a portion of said lock body is contained within said first member and at least a portion of said first member is hidden from view when said second locking element secures said lock body to said second member.

15. The assembly of claim 13, wherein at least a portion of said first member is disposed within said second member when said second locking element secures said lock body to said second member.

16. The assembly of claim 13, wherein said first member is a rail and said second member is a post.

17. The assembly of claim 13, wherein said first member and said second member are elongated.

18. The assembly of claim 13, wherein said first locking element and said second locking element are formed on an exterior surface of said lock body.

19. The assembly of claim 13, wherein said first locking element is displaced by an interior surface of said first member when a portion of said lock body is disposed in said first member until said first locking element is aligned with an opening in said first member and disposed therethrough.

20. The assembly of claim 16, wherein said rail is oriented substantially perpendicularly to said post.

21. The assembly of claim 16, wherein said rail comprises a first wall, a second wall, and a third wall, wherein said second wall and said third wall extend from said first wall in a substantially perpendicular manner.

22. The assembly of claim 21, wherein said second locking element is positioned between said second wall and said third wall when said first locking element secures said lock body to said first member.

23. The assembly of claim 22, wherein said first locking element is configured to engage a portion of said first wall.

24. The assembly of claim 17, wherein said lock body is elongated and wherein said lock body and said first member have a common longitudinal axis when said first locking element secures said lock body to said first member.

* * * * *